US006392180B1

(12) United States Patent
Yu

(10) Patent No.: US 6,392,180 B1
(45) Date of Patent: May 21, 2002

(54) PRESS BUTTON

(76) Inventor: Tsung-Mou Yu, 4, Sublane 2, Lane 23, Sec.3, Pa Te Road, Panchiao City, Taipei Hsien (TW)

( * ) Notice: Subject to any disclaimer, the term of this patent is extended or adjusted under 35 U.S.C. 154(b) by 0 days.

(21) Appl. No.: 09/789,608

(22) Filed: Feb. 22, 2001

(51) Int. Cl.[7] ..... H01H 13/56
(52) U.S. Cl. ..... 200/523
(58) Field of Search ..... 200/523, 524

(56) References Cited

U.S. PATENT DOCUMENTS 4,447,686 A * 5/1984 Fieber et al. ..... 200/153 J
4,661,667 A * 4/1987 Sorimachi et al. ..... 200/314
5,280,148 A * 1/1994 Cummins ..... 200/524
5,841,085 A * 11/1998 Rittinghaus et al. ..... 200/16 R

* cited by examiner

*Primary Examiner*—P. Austin Bradley
*Assistant Examiner*—Lisa N. Klaus
(74) *Attorney, Agent, or Firm*—Rosenberg, Klein & Lee

(57) ABSTRACT

The present invention relates to a press button which includes a main body, a press element and a push-pull element pivotably connected to the bottom of the press element. A curved crossed slide groove consisting of a plurality of slide rails is disposed on the inner wall of the main body, and a higher and a lower locating positions are formed in the slide groove. When the press element is pressed down, it slides along a preset path of the slide groove while it can be locked at the higher or the lower locating positions. Therefore, the change of the position of the press element can be completed by driving force in different directions when it is switched to two different locating positions.

2 Claims, 7 Drawing Sheets

PRESS BUTTON

BACKGROUND OF THE INVENTION

1. Field of the Invention

The present invention relates to a press button, and more particularly to a two-stage press button whose locating positions in switching can be changed in different directions.

2. Description of the Prior Art

A two-stage press button is often used to control the height of a pressed member or to change the position thereof for electric appliances, stationery, machines, daily essentials, etc. The principal and the configuration thereof are the same as that of a press-type ball point pen that is only movable straight up and down by a pressing action. Hence, the function thereof is much limited in use because it is not applicable to objects that can't be controlled by the straight displacement.

A conventional two-stage press button is shown in FIGS. 10 and 11. When the press element 101 of the main body 100 is situated at the position (H), a locking element 103 of the main body 100 is fixed at a lower position (II) of a heart-shaped slide groove 102 of the press element 101 while a spring 104 supports against the press element 101. Therefore, a first locating stage at a higher position is formed. When the press element 101 is pressed down to the position (L), the locking element 103 of the main body 100 is fixed at a higher position (I) of the heart-shaped slide groove 102 of the press element 101, thereby forming a second locating stage at a lower position. Accordingly, the locating positions of the press element 101 in switching can only be changed in an upward and downward straight way. The displacement of the press element 101 in different directions can't be reached so that the function thereof is much limited.

SUMMARY OF THE INVENTION

It is a primary object of the present invention to eliminate the drawbacks of the up and down switching way of the conventional two-stage press button and to provide a press button which can be switched in a way of different directions.

It is another object of the present invention to provide a press button which is applicable to electric appliances, toys or other objects in order to reaching the convenience and the safety in use.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
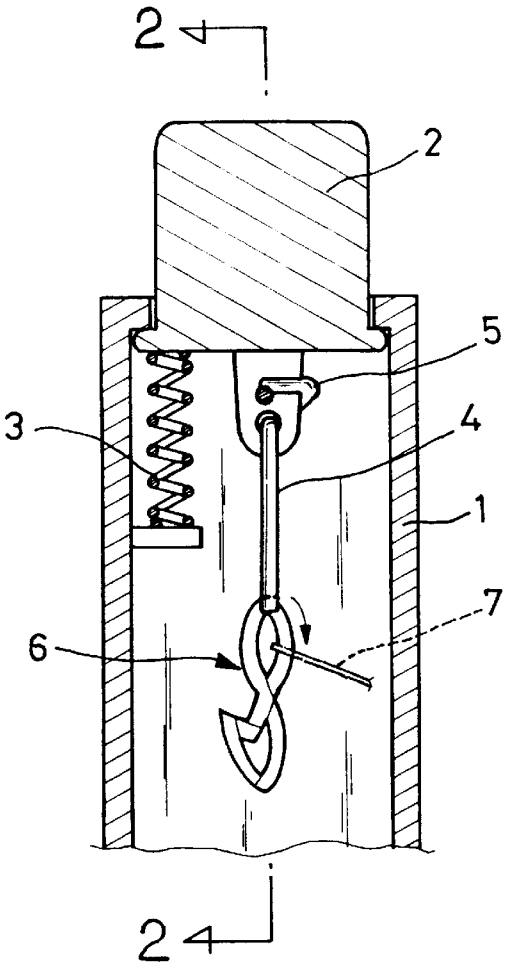
FIG. 1 is a sectional view of an applicable embodiment of the present invention, showing a press element before being pressed down.

First of all, referring to FIGS. 3 through 9, an applicable embodiment of the present invention includes a main body 1 and a push-pull element 4. The main body 1 is hollow-shaped and has a press element 2 at top thereof. At least one supporting resilient element 3 is disposed beneath the press element 2 so that the press element 2 has a upward resilient force. The push-pull element 4 is pivotably connected to the press element and being movable therewith.

In addition, the inner wall of the rear side of the main body includes a curved crossed slide groove 6 at the elevating position of the push-pull element 4. The slide groove 6 is directed from a higher first locating position I downwards in a curved way to a first turning position I', thereby forming a first slide rail 61. Thereafter, it is directed upwards and in the left direction to a second locating position II, thereby forming a second slide rail 62. Thus, the second locating position II is situated lower than the first locating position I and to the left side thereof. Then, the second locating position II is directed downwards in the right direction to a second turning position II', thereby forming a third slide rail 63 while a fourth slide rail 64 is directed from the second turning position II' upwards in a curved way and returns to the first locating position I after intersecting the first slide rail 61 to, thereby fonming an 8-shape slide groove 6. Moreover, a stepped drop side 611, 621, 631, 641, 642 is respectively formed at the connection and the cross positions between every two slide rails 61, 62, 63, 64.

Furthermore, a cross bar 41 is fitted to the bottom end of the push-pull element 4 and the inner end thereof is arranged in the slide groove 6, and a resilient piece 5 is fitted to the outer side of the push-pull element 4 so that the push-pull element 4 has an inward resilient force.

Therefore, the slide path and the locating position of the push-pull element 4 in the slide groove 6 can be changed, thereby creating a downward push force or a upward pull force in different directions. Accordingly, the position of a driven member 7 inside of the main body 1 and at side of the slide groove 6 is up and down changeable.

The most significant feature of the present invention is the 8-shaped slide groove 6 and the push-pull element 4 that changes its position along the slide groove 6. By cooperation of these two elements, the drawbacks of the conventional two-stage press buttons are eliminated.

Figure 2:
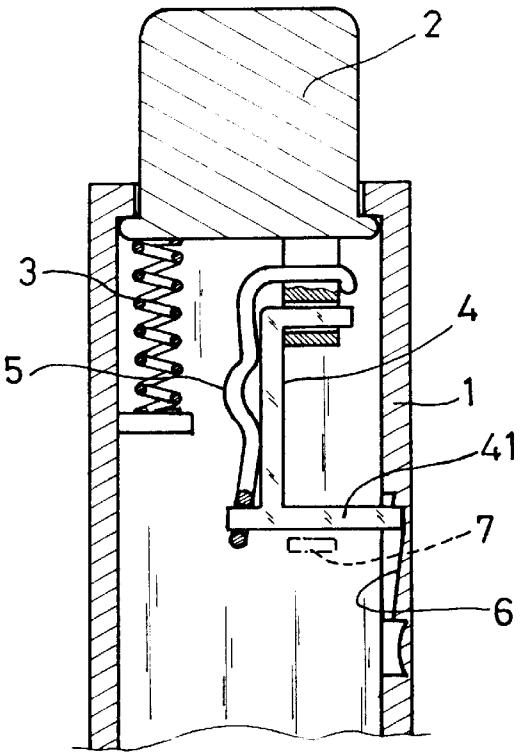
FIG. 2 is a sectional view taken along the line 2—2 of FIG. 1.
Figure 3:
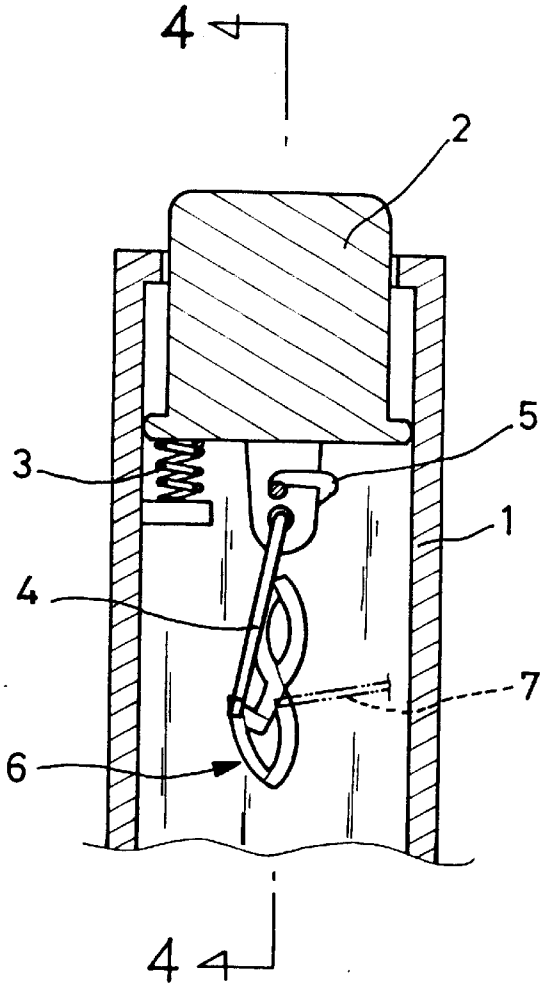
FIG. 3 is a sectional view of the applicable embodiment of the present invention, showing a press element after being pressed down.
Figure 4:
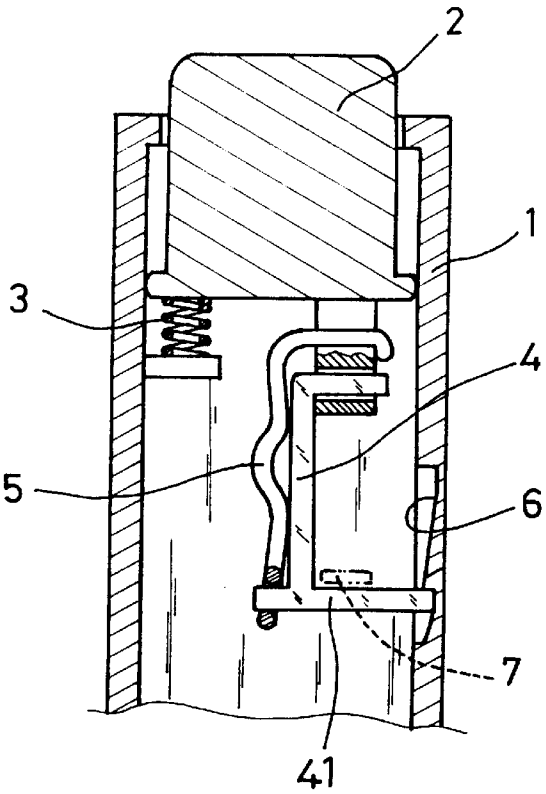
FIG. 4 is a sectional view taken along the line 4—4 of FIG. 3.
Figure 5:
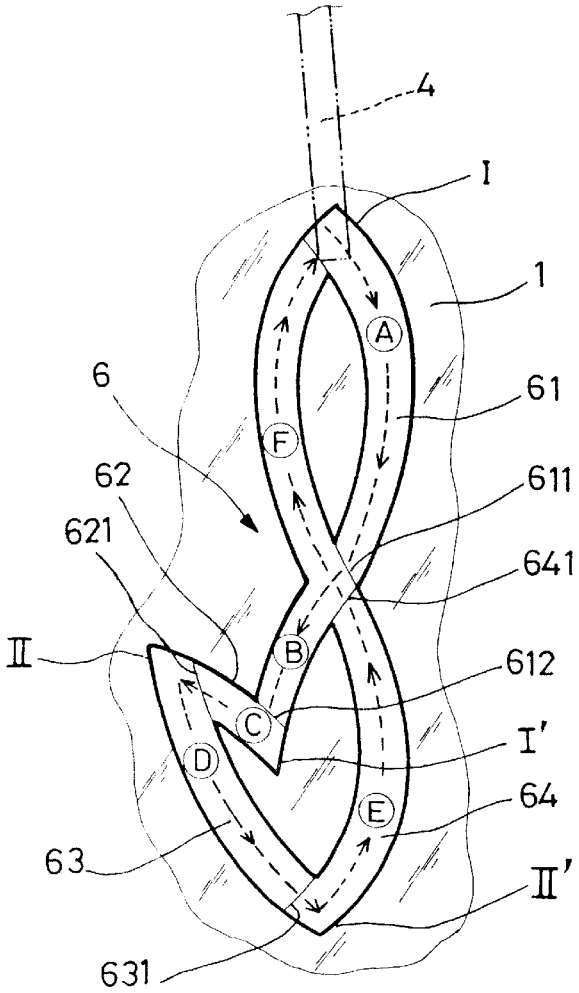
FIG. 5 is a schematic drawing of a slide groove of the present invention.
Figure 6:
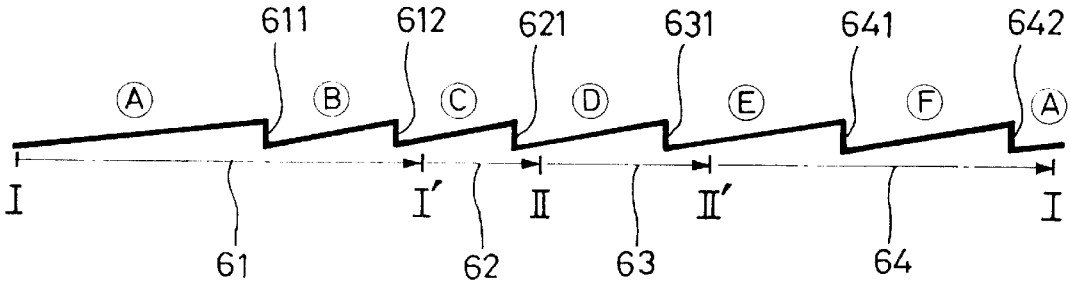
FIG. 6 is a developed view of a slide groove of the present invention.
Figure 7:
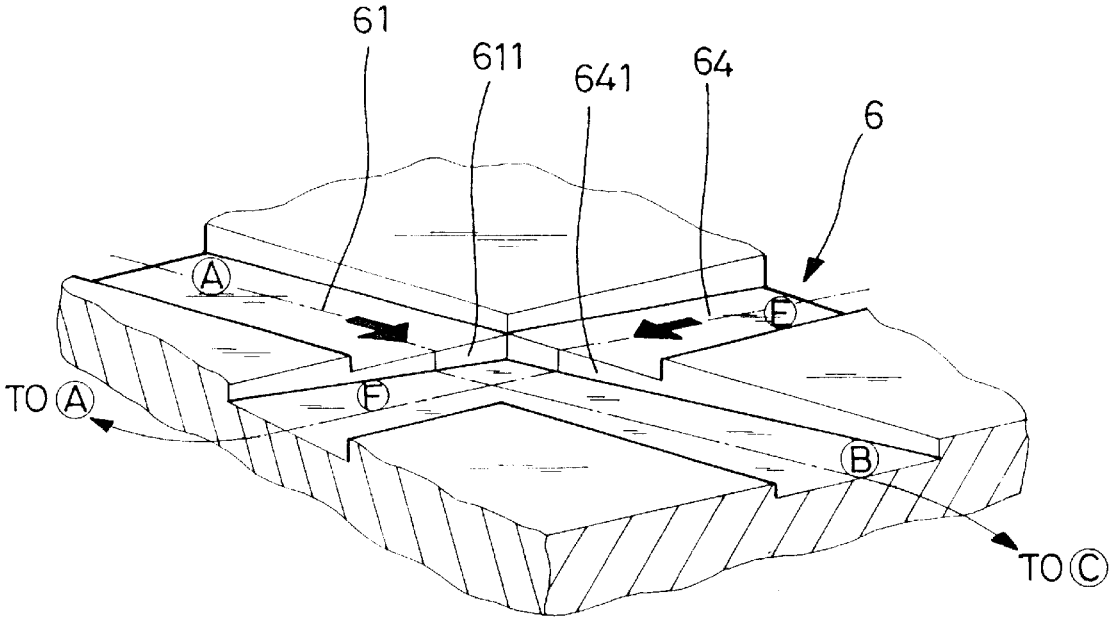
FIG. 7 is an enlarged view of the portion (C) of FIG. 5.

Referring to FIGS. 1 and 2 together with FIGS. 5 and 6, before the press element 2 is pressed down, the press element 2 projects above the main body 1. At that time, the inner end of the cross bar 41 of the push-pull element 4 is situated at the higher first locating position I inside the slide groove 6. The detailed configuration of the slide groove 6 is shown in FIGS. 5 through 7. When the press element 2 is pressed down, the push-pull element 4 is moved along the first slide rail 61 downwards and then reaches the first turning position I'. While the push-pull element 4 moves downwards, the cross bar 41 presses the driven member 7 downwards so that the position of the driven member 7 is changed, as shown in FIGS. 3 and 4. At that time, the push-pull element 4 falls from the first slide rail 61 to the second slide rail 62, and then moves along the second slide rail 62 to the second locating position II by means of the upward resilience of the resilient element 3 at the bottom end of the press element 2. Accordingly, the press element 2 is pressed down in a locked state. Since the push-pull element 4 is locked at the second locating position II between the second slide rail 62 and the third slide rail 63, the press element 2 won't return upwards. Its apparent from FIGS. 3 and 4 that the driven member 7 is situated beneath, and no blocking objects (e.g. push-pull element 4) are present above. This differs much from the conventional two-stage press button. In other words, the push-pull element 4 of the present invention is situated at the outer side after the push-pull element 4 moves the driven member 7 downwards to change its position so that the driven member 7 is not movable with the push-pull element 4 and situated in an independent free state.

Furthermore, in order to bring the press element 2 back to its original position or to bring the driven member 7 to the upper position, its only required to press down the press element 2. Then, the push-pull element 4 moves from the second locating position II along the third slide rail 63 to the second turning position II' between the third slide rail 63 and the fourth slide rail 64. By means of the upward resilience of the resilient element 3 at the bottom end of the press element 2, the push-pull element 4 slides rapidly along the fourth slide rail 64 upwards through the intersection of the fourth slide rail 64 and the first slide rail 61 back to the first locating position I. Meanwhile, the driven member 7 situated beneath can be pulled upwards and brought to the upper position, as shown in FIGS. 1 and 2. At this time, the push-pull element 4 is brought above the driven member 7, and the driven member 7 is ready to be pushed by the push-pull element 4 from the first slide rail 61 to change its position again.

That the push-pull element 4 is slidable along the slide rails 61, 62, 63, 64 in the curved crossed slide groove 6 successively is completed on two pre-conditions. Firstly, a stepped drop side 611, 621, 631, 641, 642 is respectively formed at the connection and the cross positions between every two slide rails 61, 62, 63, 64, as shown in FIGS. 5 through 7. Secondly, the cross bar 41 has always a resilient force in the direction of the slide groove 6 by means that the resilient piece 5 is fitted to the outer side of the push-pull element 4. These two features enable the push-pull element 4 to slide from the first locating position I along a slope A of the first slide rail 61 to fall into a slope B, thereby reaching a slope C of the second slide rail 62. Thereafter, the push-pull element 4 slides rapidly to the second locating position II. Then, it passes through slopes D, E, F successively and returns to the first locating position I. The stepped drop sides are formed by means that each of the slopes A~F ranges ups and downs. The curved crossed 8-shape of the slide groove 6 enables itself to dodge the driven member 7 so that the position of the driven member 7 can be changed by means of the force in different directions. Meanwhile, the driven member 7 can be kept in free state at ordinary times without being blocked by the press element 2 and the push-pull element 4.

Figure 8:
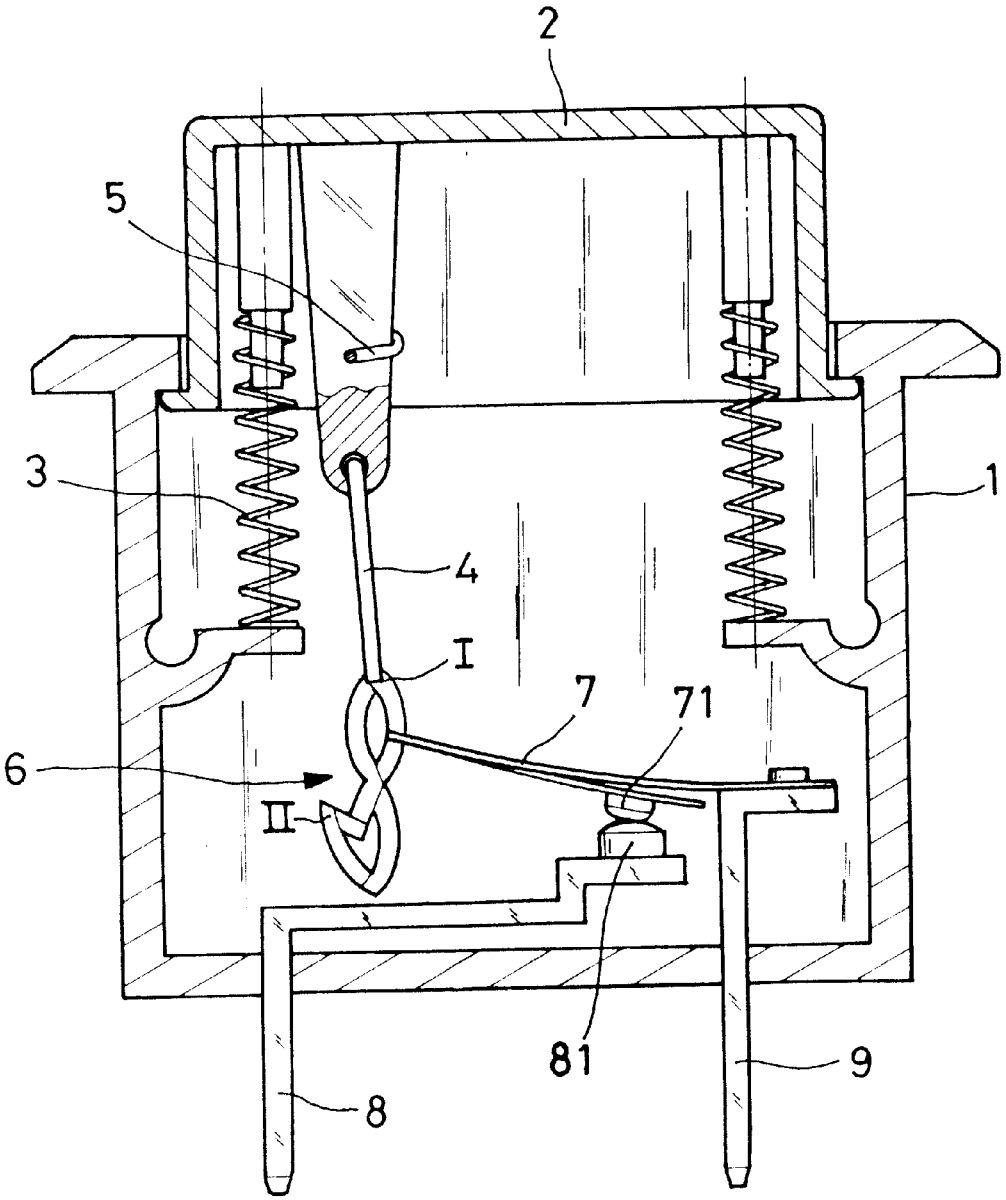
FIG. 8 is a schematic drawing of an embodiment of the present invention applied to a safety switch in an on-state.
Figure 9:
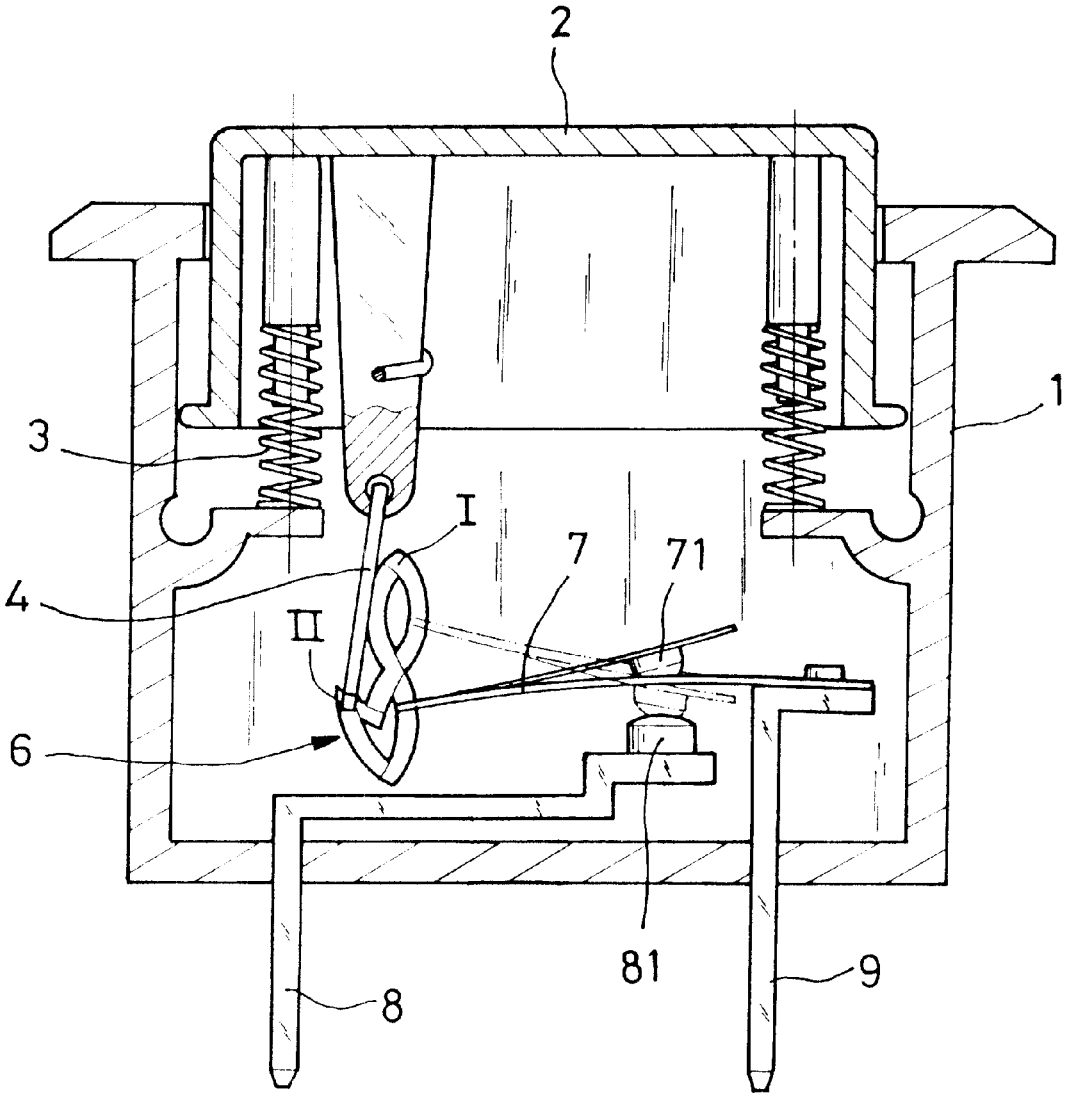
FIG. 9 is a schematic drawing of an embodiment of the present invention applied to a safety switch in an off-state.
Figure 11:
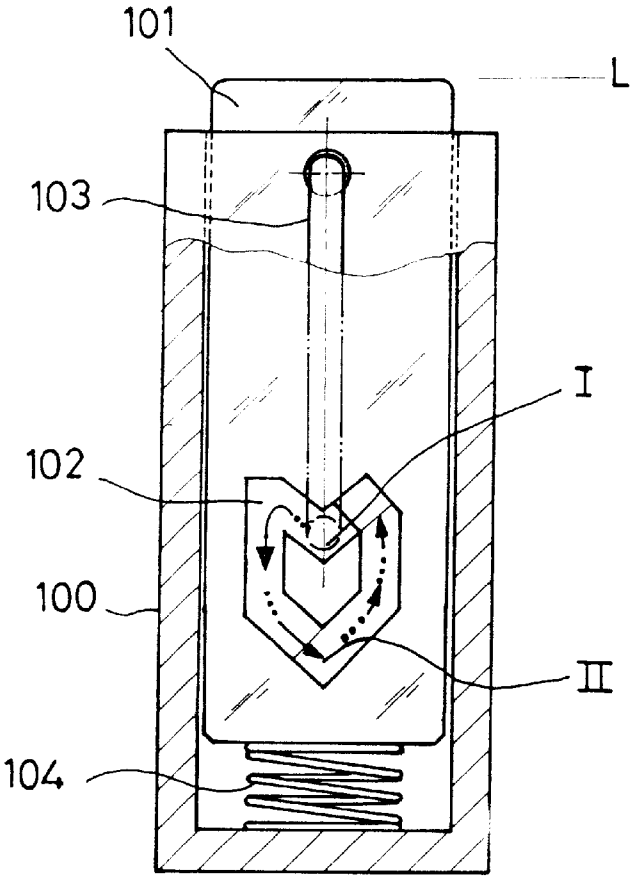
FIG.11 (PRIOR ART)
Figure 10:
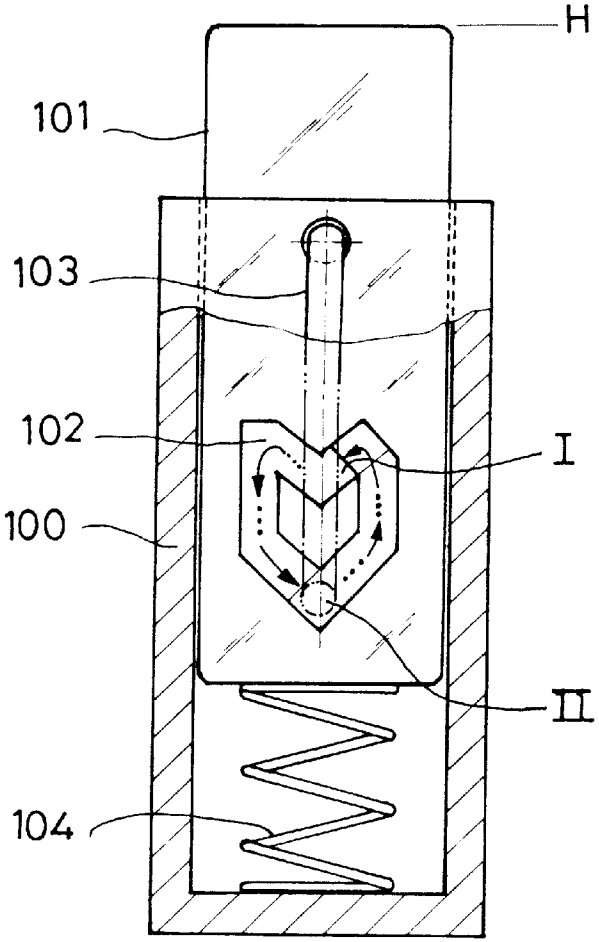
FIG.10 (PRIOR ART)
FIG. 10 is a schematic drawing of a conventional two-stage press button, showing the press element situated at a higher position; and, FIG. 11 is a schematic drawing of a conventional two-stage press button, showing the press element situated at a lower position.

The press button of the present invention can be applicable to various products. An application embodiment is described as follows:

Referring to FIGS. 8 and 9, the aforementioned driven member 7 applied to the safety switch is the conductive strip 7 whose tail is fixed on a conductive plate 9. The conductive strip 7 has a conductive boss 71. Another conductive strip 8 also includes a conductive boss 81. In pressing the press element 2 downwards, the push-pull element 4 slides from the first locating position I along the slide groove 6 to the lower second locating position II. Meanwhile, the position of the conductive strip 7 is changed in a downward pushing way, as shown in FIG. 9. After the press element 2 is pressed down again, the resilient element 3 provides an upward resilient force, thereby enabling the push-pull element 4 to slide from the second locating position II along the preset path of the slide groove 6 back to the first locating position I. At this time, the push-pull element 4 pulls the conductive strip 7 upwards so that the free end of the conductive strip 7 is moved upwards and the conductive strip 7 returns to its original position, as shown in FIG. 8.

An Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A press button apparatus comprising:

(a) a main body having a slide groove formed in a wall surface thereof, said slide groove including a plurality of slide rail segments collectively describing an endlessly looped configuration defining at least first and second locating portions, at least a pair of said slide rail segments being disposed one traversing the other, said slide groove including a stepped portion defined at each transition between adjacent slide rail segments and at each traversal of said slide rail segments;

(b) a press element coupled to said main body in longitudinally displaceable manner;

(c) at least one resilient element coupled to said press element and said main body for resiliently biasing said press element to a first position relative to said main body;

(d) a push-pull element having a first end portion pivotally coupled to said press element for displacement therewith, said push-pull element having a second end portion slidably engaging said slide groove of said main body, said second end portion engaging said first and second locating portions of said slide groove in releasably locked manner; and (e) a resilient piece coupled to said push-pull element for resiliently biasing said push-pull element toward said slide groove;

whereby said push-pull element is adjustable in position to at least first and second releasably locked positions responsive to respectively corresponding longitudinal displacement of said press element relative to said main body.

2. A press button apparatus comprising:

(a) a main body having a slide groove formed in a wall surface thereof, said slide groove including a plurality of slide rail segments collectively describing a substantially figure eight-shaped configuration defining at least first and second locating portions and at least first and second turning portions;

a first of said slide rail segments arcuately extending downward from said first locating portion to said first turning portion, a second of said slide rail segments arcuately extending upward from said first turning portion to said second locating portion, a third of said slide rail segments arcuately extending downward from said second locating portion to said second turning portion, a fourth of said slide rail segments arcuately extending upward from said second turning portion to said first locating portion, said fourth slide rail segment traversing said first slide rail segment;

said slide groove including a stepped portion defined at each transition between adjacent ones of said slide rail segments and at said traversal of said first and fourth slide rail segments;

(b) a press element coupled to said main body in longitudinally displaceable manner;

(c) at least one resilient element coupled to said press element and said main body for resiliently biasing said press element to a first position relative to said main body;

(d) a push-pull element having a first end portion pivotally coupled to said press element for displacement therewith, said push-pull element having a second end portion slidably engaging said slide groove of said main body, said second end portion engaging said first and second locating portions of said slide groove in releasably locked manner; and (e) a resilient piece coupled to said push-pull element for resiliently biasing said push-pull element toward said slide groove;

whereby said push-pull element is adjustable in position to at least first and second releasably locked positions responsive to respectively corresponding longitudinal displacement of said press element relative to said main body.

* * * * *